US009506362B2

(12) United States Patent
Burdgick

(10) Patent No.: US 9,506,362 B2
(45) Date of Patent: Nov. 29, 2016

(54) STEAM TURBINE NOZZLE SEGMENT HAVING TRANSITIONAL INTERFACE, AND NOZZLE ASSEMBLY AND STEAM TURBINE INCLUDING SUCH NOZZLE SEGMENT

(71) Applicant: General Electric Company, Schenectady, NY (US)

(72) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 490 days.

(21) Appl. No.: 14/085,232

(22) Filed: Nov. 20, 2013

(65) Prior Publication Data

US 2015/0139790 A1 May 21, 2015

(51) Int. Cl.
*F01D 9/04* (2006.01)

(52) U.S. Cl.
CPC ..... *F01D 9/042* (2013.01); *F05D 2250/711* (2013.01); *F05D 2250/712* (2013.01); *F05D 2250/73* (2013.01)

(58) Field of Classification Search
CPC ..... F01D 9/042; F01D 9/044; F01D 9/04; F01D 5/22; F01D 5/225; F01D 9/02; F05D 2240/10; F05D 2240/11; F05D 2240/25; F05D 2250/71; F05D 2250/711; F05D 2250/712; F05D 2250/73
See application file for complete search history.

(56) References Cited

U.S. PATENT DOCUMENTS 4,025,229 A 5/1977 Browning et al.
4,639,189 A 1/1987 Rosman
6,283,713 B1 9/2001 Harvey et al.
6,290,459 B1 9/2001 Correia
6,592,326 B2 7/2003 Marx et al.
6,887,040 B2 5/2005 Tiemann et al.
7,186,074 B2 3/2007 Blatchford et al.
7,427,187 B2 9/2008 Burdgick et al.
8,967,973 B2 * 3/2015 Ingram ..... 416/191
2002/0028139 A1 3/2002 Gunn et al.

(Continued)

FOREIGN PATENT DOCUMENTS

GB 918682 A 2/1963
JP 59066948 4/1984

(Continued)

OTHER PUBLICATIONS

U.S. Appl. No. 12/706,198, Office Action dated Oct. 1, 2013.

(Continued)

*Primary Examiner* — Eric Keasel
*Assistant Examiner* — Danielle M Christensen
(74) *Attorney, Agent, or Firm* — Ernest G. Cusick; Hoffman Warnick LLC

(57) ABSTRACT

Various embodiments include steam turbine static nozzles having transitional interfaces. In one embodiment a steam turbine static nozzle blade includes: an airfoil; an inner sidewall integral with a first side of the airfoil; and an outer sidewall integral with a second side of the airfoil; the inner sidewall and the outer sidewall each including: a first side having one of: an arcuate concave surface extending substantially an entire length of the sidewall, or an arcuate convex surface extending substantially the entire length of the sidewall; and a second side opposing the first side and having an angled interface extending substantially the entire length of the sidewall.

14 Claims, 6 Drawing Sheets

(56) References Cited

U.S. PATENT DOCUMENTS

| | | | | |
|---|---|---|---|---|
| 2003/0133802 | A1* | 7/2003 | Tiemann | F01D 5/147 416/189 |
| 2007/0166151 | A1 | 7/2007 | Burdgick et al. | |
| 2010/0028143 | A1* | 2/2010 | Bailey | B23P 6/002 415/202 |
| 2010/0183435 | A1 | 7/2010 | Campbell et al. | |
| 2011/0200430 | A1* | 8/2011 | Burdgick | F01D 5/147 415/209.3 |
| 2013/0011265 | A1* | 1/2013 | Miller | F01D 11/008 416/191 |
| 2014/0037442 | A1* | 2/2014 | Tatman | F01D 9/042 415/208.1 |

FOREIGN PATENT DOCUMENTS

| | | | |
|---|---|---|---|
| JP | 60-022002 | | 2/1985 |
| JP | 2002-061600 | A | 2/2002 |
| JP | 2005-146896 | A | 6/2005 |
| JP | 2008-144687 | A | 6/2008 |
| JP | 2008-534837 | A | 8/2008 |
| WO | 2008-084038 | A1 | 7/2008 |
| WO | 2008084038 | A1 | 7/2008 |

OTHER PUBLICATIONS

U.S. Appl. No. 12/706,198, Office Action dated Feb. 27, 2013.
U.S. Appl. No. 12/706,198, Office Action dated Aug. 30, 2013.
Office Action Communication for Russian Application No. 2011105278/06(007501), dated Apr. 15, 2015, 14 Pages. English Language Translation included.

* cited by examiner

STEAM TURBINE NOZZLE SEGMENT HAVING TRANSITIONAL INTERFACE, AND NOZZLE ASSEMBLY AND STEAM TURBINE INCLUDING SUCH NOZZLE SEGMENT

FIELD OF THE INVENTION

The subject matter disclosed herein relates to steam turbomachines (turbines). Specifically, the subject matter disclosed herein relates to a steam turbomachine nozzle assembly and nozzles within such an assembly.

BACKGROUND OF THE INVENTION

Steam turbines include static nozzle (or "airfoil") segments that direct flow of a working fluid into turbine buckets connected to a rotating rotor. A complete assembly of nozzle segments is commonly referred to as a diaphragm stage of the steam turbine. One method of constructing the diaphragm stage is to weld (or alternatively, braze) a plurality of single airfoils with integrated sidewalls ("static nozzle blades", or "singlets") to inner and outer rings. Each of these singlets have interfaces to which adjacent singlets are welded or brazed (in the inner and outer ring). These interfaces include an axial leading edge section (or "pressure-side" section) oriented parallel to the steam turbine's axis, and an angled trailing edge section (or "suction-side" section). While some prior singlet designs included angled interface sections allows for a tight fit between individual segments, the angled interfaces make removal and repair of individual segments nearly impossible.

More recent nozzle segments have incorporated arcuate sidewalls which permit removal of individual static nozzle segments from the ring without requiring removal of adjacent nozzle segments. However, these arcuate designs are not compatible with existing angled singlet sections, and as such, have been limited in use to new machinery manufactured with an entire section of nozzles having angled faces.

BRIEF DESCRIPTION OF THE INVENTION

Various embodiments include steam turbine nozzle segments with transitional interfaces. In one embodiment a steam turbine static nozzle blade includes: an airfoil; an inner sidewall integral with a first side of the airfoil; and an outer sidewall integral with a second side of the airfoil; the inner sidewall and the outer sidewall each including: a first side having one of: an arcuate concave surface extending substantially an entire length of the sidewall, or an arcuate convex surface extending substantially the entire length of the sidewall; and a second side opposing the first side and having an angled interface extending substantially the entire length of the sidewall.

A first aspect includes: a steam turbine static nozzle blade includes: an airfoil; an inner sidewall integral with a first side of the airfoil; and an outer sidewall integral with a second side of the airfoil; the inner sidewall and the outer sidewall each including: a first side having one of: an arcuate concave surface extending substantially an entire length of the sidewall, or an arcuate convex surface extending substantially the entire length of the sidewall; and a second side opposing the first side and having an angled interface extending substantially the entire length of the sidewall.

A second aspect includes: a steam turbine diaphragm assembly having: an outer diaphragm ring; an inner diaphragm ring; an annulus of static nozzle blades between the inner diaphragm ring and the outer diaphragm ring, the annulus of static nozzle blades including: a first static nozzle blade including: an airfoil; an inner sidewall integral with a first side of the airfoil; and an outer sidewall integral with a second side of the airfoil; the inner sidewall and the outer sidewall each including: a pressure side having an arcuate concave surface extending substantially an entire length of the sidewall; and a suction side having an arcuate convex surface extending substantially the entire length of the sidewall; and a second static nozzle blade including: an airfoil; an inner sidewall integral with a first side of the airfoil; and an outer sidewall integral with a second side of the airfoil; the inner sidewall and the outer sidewall each including: a first side having one of: an arcuate concave surface extending substantially an entire length of the sidewall, or an arcuate convex surface extending substantially the entire length of the sidewall, the first side complementing one of the pressure side or the suction side of the first static nozzle blade; and a second side opposing the first side and having an angled interface extending substantially the entire length of the sidewall.

A third aspect includes: a steam turbine having: a casing segment; and a nozzle assembly at least partially contained within the casing segment, the nozzle assembly including: an outer diaphragm ring; an inner diaphragm ring; an annulus of static nozzle blades between the inner diaphragm ring and the outer diaphragm ring, the annulus of static nozzle blades including: a first static nozzle blade including: an airfoil; and a pair of sidewalls integral with the airfoil, the pair of sidewalls each including: a pressure side having an arcuate concave surface extending substantially an entire length of the sidewall; and a suction side having an arcuate convex surface extending substantially the entire length of the sidewall; and a second static nozzle blade including: an airfoil; and a pair of sidewalls integral with the airfoil, the pair of sidewalls each including: a first side having one of: an arcuate concave surface extending substantially an entire length of the sidewall, or an arcuate convex surface extending substantially the entire length of the sidewall, the first side complementing one of the pressure side or the suction side of the first static nozzle blade; and a second side opposing the first side and having an angled interface extending substantially the entire length of the sidewall.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
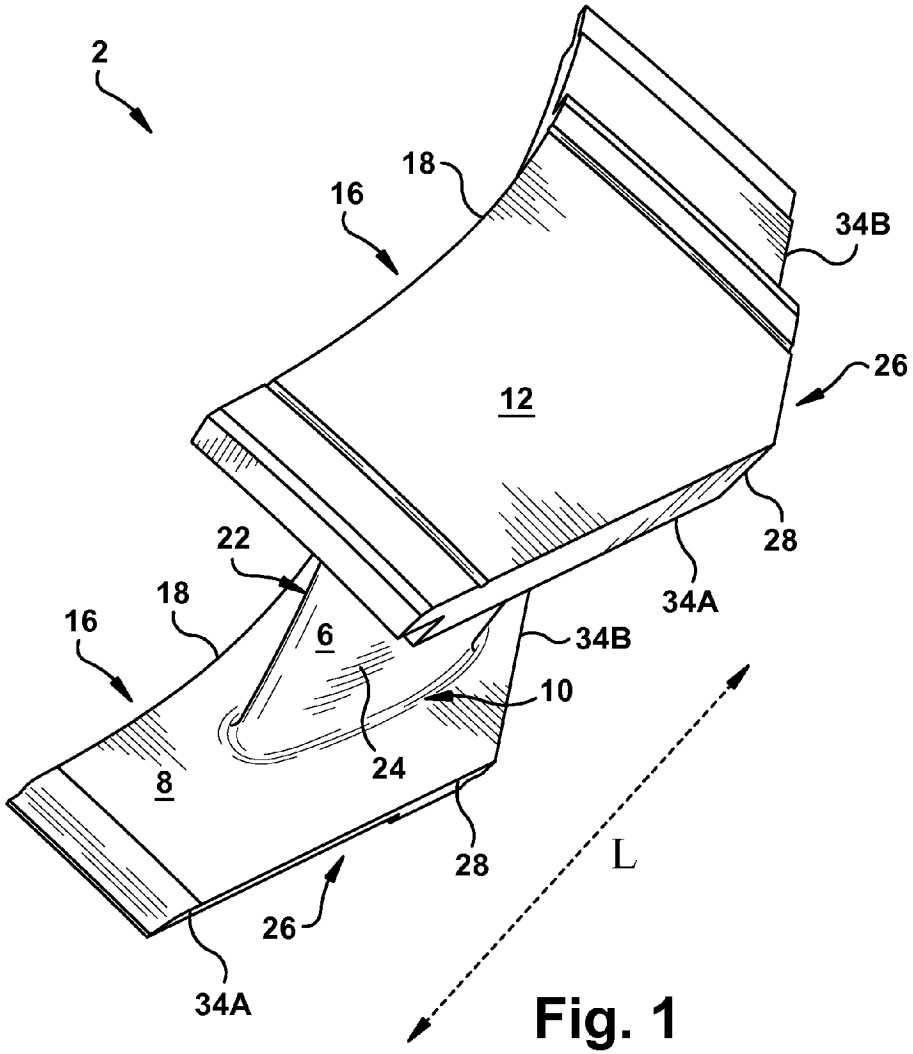
FIG. 1 shows a three-dimensional perspective view of a transitional static nozzle airfoil according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide for a steam turbine nozzle segment having a transitional interface. Specifically, aspects of the invention provide for a steam turbine nozzle assembly including at least one nozzle segment with an angled interface (along sidewalls), at least one nozzle segment with arcuate or "conical" (e.g., arced concave, arced convex) interfaces, and at least one nozzle segment having transitional interfaces complementing both the angled and arcuate interfaces. These transitional interfaces can allow for, among other things, transition of older angled-face designs to newer conical designs on a nozzle-by-nozzle (or multiple nozzles-by-nozzles basis).

As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Inner and outer, as used herein, can refer to a radial position along axis (r). Additionally, the terms "circumferential" and/or "circumferentially" refer to the relative position/direction of objects along a circumference which surrounds axis A but does not intersect the axis A at any location.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Various particular embodiments include a steam turbine static nozzle blade includes: an airfoil; an inner sidewall integral with a first side of the airfoil; and an outer sidewall integral with a second side of the airfoil; the inner sidewall and the outer sidewall each including: a first side having one of: an arcuate concave surface extending substantially an entire length of the sidewall, or an arcuate convex surface extending substantially the entire length of the sidewall; and a second side opposing the first side and having an angled interface extending substantially the entire length of the sidewall.

Additional particular embodiments include a steam turbine diaphragm assembly having: an outer diaphragm ring; an inner diaphragm ring; an annulus of static nozzle blades between the inner diaphragm ring and the outer diaphragm ring, the annulus of static nozzle blades including: a first static nozzle blade including: an airfoil; an inner sidewall integral with a first side of the airfoil; and an outer sidewall integral with a second side of the airfoil; the inner sidewall and the outer sidewall each including: a pressure side having an arcuate concave surface extending substantially an entire length of the sidewall; and a suction side having an arcuate convex surface extending substantially the entire length of the sidewall; and a second static nozzle blade including: an airfoil; an inner sidewall integral with a first side of the airfoil; and an outer sidewall integral with a second side of the airfoil; the inner sidewall and the outer sidewall each including: a first side having one of: an arcuate concave surface extending substantially an entire length of the sidewall, or an arcuate convex surface extending substantially the entire length of the sidewall, the first side complementing one of the pressure side or the suction side of the first static nozzle blade; and a second side opposing the first side and having an angled interface extending substantially the entire length of the sidewall.

Other particular embodiments include a steam turbine having: a casing segment; and a diaphragm assembly at least partially contained within the casing segment, the diaphragm assembly including: an outer diaphragm ring; an inner diaphragm ring; an annulus of static nozzle blades between the inner diaphragm ring and the outer diaphragm ring, the annulus of static nozzle blades including: a first static nozzle blade including: an airfoil; and a pair of sidewalls integral with the airfoil, the pair of sidewalls each including: a pressure side having an arcuate concave surface extending substantially an entire length of the sidewall; and a suction side having an arcuate convex surface extending substantially the entire length of the sidewall; and a second static nozzle blade including: an airfoil; and a pair of sidewalls integral with the airfoil, the pair of sidewalls each including: a first side having one of: an arcuate concave surface extending substantially an entire length of the sidewall, or an arcuate convex surface extending substantially the entire length of the sidewall, the first side complementing one of the pressure side or the suction side of the first static nozzle blade; and a second side opposing the first side and having an angled interface extending substantially the entire length of the sidewall.

Figure 2:
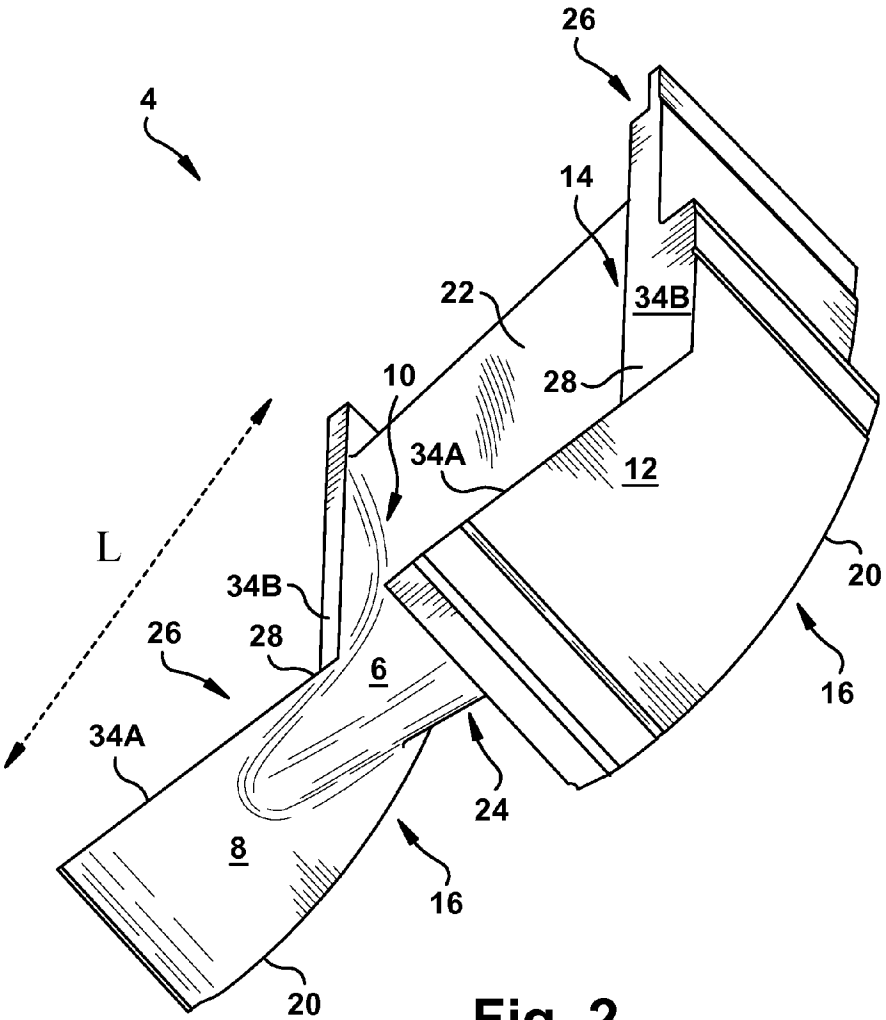
FIG. 2 shows a three-dimensional perspective view of a transitional static nozzle airfoil according to various embodiments.

FIG. 1 shows a schematic perspective view of one embodiment of a transitional static nozzle blade (blade A) 2; and FIG. 2 shows a schematic perspective view of a second embodiment of a transitional static nozzle blade (blade B) 4, according to various embodiments. It is understood that blades 2, 4 can have similar general features, but are sized and shaped distinctly to join with distinct adjacent blades in an annulus of static nozzle blades. In any case, blades 2, 4 can each include: an airfoil 6, an inner sidewall 8 integral with a first side 10 of the airfoil 6 (e.g., via machining from a forging or block, welding, casting, brazing, etc.), and an outer sidewall 12 (obstructed in FIG. 1) integral with a second side 14 of the airfoil 6 (e.g., via machining from a forging or block, welding, casting, brazing, etc.). The inner sidewall 8 and outer sidewall 12 are each configured to contact and complement an adjacent static nozzle blade in a static nozzle blade assembly.

The inner sidewall 8 and the outer sidewall 12 can each include a first side 16 having one of an arcuate concave surface 18 (e.g., in blade 2) extending substantially an entire length (L) of the sidewall 8, 12, or an arcuate convex surface 20 (e.g., in blade 4) extending substantially the entire length (L) of the sidewall 8, 12. In the case of blade 2, in FIG. 1, the first side 16 includes an arcuate concave surface 18 on the pressure side 22 of the blade 2, that is, the side which coincides with the pressure side of the airfoil 6. In the case of blade 4, in FIG. 2, the first side 16 includes an arcuate convex surface 20 on the suction side 24 of the blade 4, that is, the side which coincides with the suction side of the airfoil 6. The terms "pressure side" and "suction side" correspond to the pressure side and suction side of airfoil 6, respectively. As is known in the art, the pressure side of airfoil 6 is the high-pressure side designed to guide the flow of a working fluid through the blade 2, 4. As is further known in the art, the suction side of airfoil 6 is the lower-pressure side substantially opposing the pressure side.

Further, as described herein, the inner sidewall 8 and the outer sidewall 12 can each include a second side 26 opposing the first side 16 and having an angled interface 28 extending substantially the entire length (L) of the sidewall 8, 12. In the case of blade 2, in FIG. 1, the second side 26 is on the suction side of the blade 2, that is, the side which coincides with the suction side 24 of the airfoil 6. In the case of blade 4, in FIG. 2, the second side 26 is on the pressure side of the blade 4, that is, the side which coincides with the pressure side 22 of the airfoil 6.

According to various embodiments, the arcuate concave surface 18 and/or the arcuate convex surface 20 has an arc radius of approximately 5.5 inches (approximately 14 centimeters). In various embodiments, the angle formed by continuous sections 34A and 34B of the angled interface 28 is between approximately 115 degrees and approximately 155 degrees As described further herein, the angled interface 28 is angled to complement an adjacent static nozzle blade in an existing static nozzle blade assembly. Additionally, the arcuate concave surface 18 and/or the arcuate convex surface 20 are each angled to complement an adjacent static nozzle blade having an arcuate interface.

Figure 3:
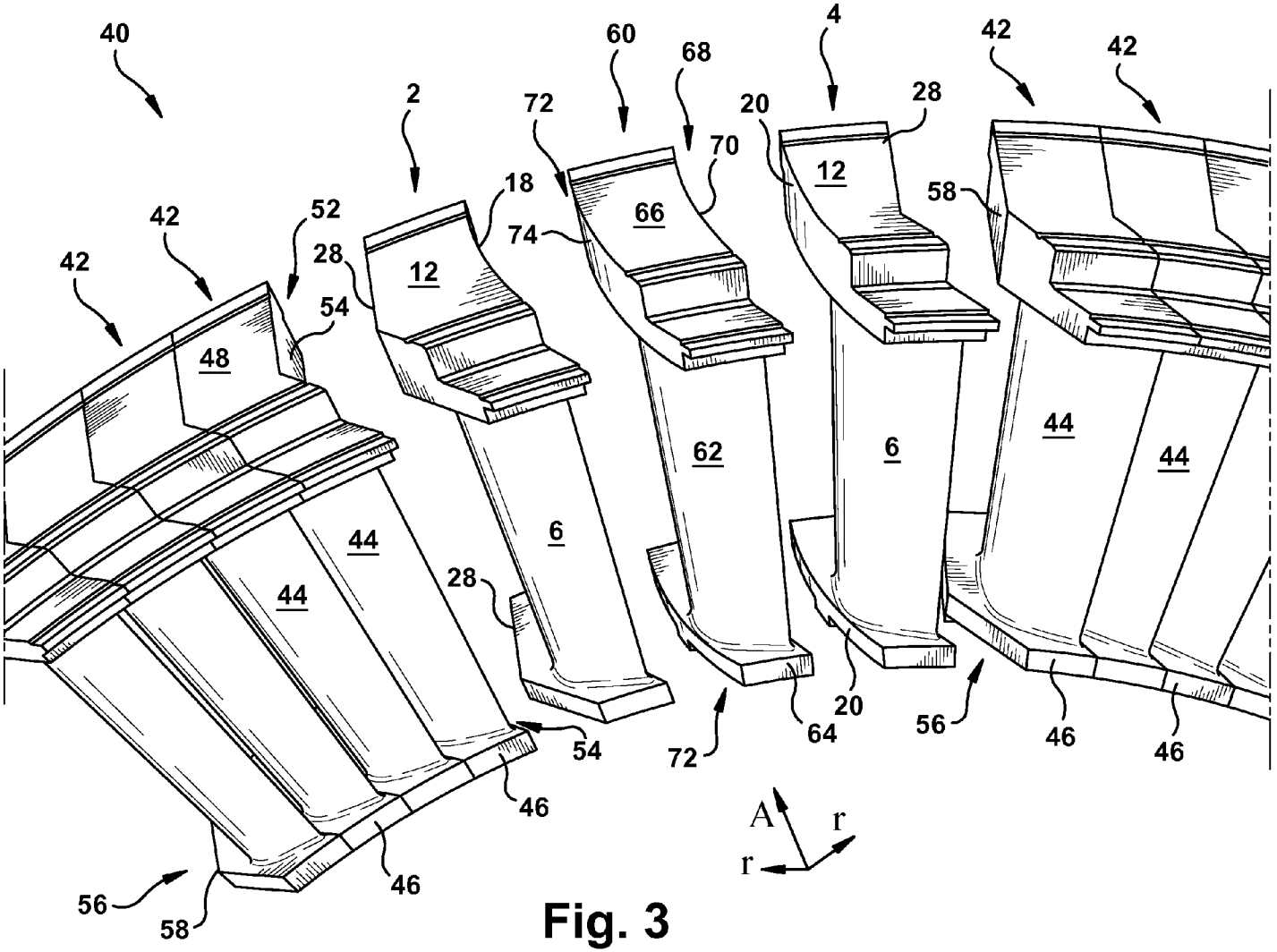
FIG. 3 shows a break-away (suspended) schematic perspective view of a portion of an annulus of static nozzle blades according to various embodiments.

FIG. 3 shows a break-away (suspended) schematic perspective view of a portion of an annulus of static nozzle blades 40, including a plurality of angled-interface static nozzle blades 42, e.g., in an existing static nozzle blade assembly. Each of the angled-interface static nozzle blades 42 includes: an airfoil 44; an inner sidewall 46 integral with a first side of the airfoil 44; and an outer sidewall 48 integral with a second side of the airfoil 44. The inner sidewall 46 and the outer sidewall 48 can each include: a pressure side 52 having an angled interface 54 extending substantially an entire length of the sidewall 46, 48; and a suction side 56 having an angled interface 58 extending substantially the entire length of the sidewall 46, 48. In various embodiments, these angled-interface static nozzle blades may be placed in the annulus 40 by an equipment manufacturer, e.g., an original equipment manufacturer (OEM). However, according to various embodiments, a method can include removing at least one angled-interface static nozzle blade 42 from the annulus 40, and replacing the removed angled-interface static nozzle blade 40 with a transitional static nozzle blade 2, 4.

In some cases, the method can include removing at least three angled-interface static nozzle blades 40, and replacing those three angled-interface static nozzle blades with a first transitional static nozzle blade 2, a second transitional static nozzle blade 4, and at least one arcuate (conical) interface static nozzle blade 60 interposed between the transitional static nozzle blades 2, 4. As shown, the arcuate interface static nozzle blade 60 can include: an airfoil 62; an inner sidewall 64 integral with a first side of the airfoil 62; and an outer sidewall 66 integral with a second side of the airfoil 62. As noted herein, the inner sidewall 64 and the outer sidewall 66 each include: a pressure side 68 having an arcuate concave surface 70 extending substantially an entire length of the sidewall 64, 66; and a suction side 72 having an arcuate convex surface 74 extending substantially the entire length of the sidewall 64, 66.

According to various embodiments, the arcuate concave surfaces 18 of the transitional blade 2 can complement the arcuate convex surfaces 74 of the arcuate-interface static nozzle blade 60, while the angled interfaces 28 can complement the angled interfaces 54 on the pressure side 52 of the angled-interface static nozzle blades 42. According to various embodiments, the arcuate convex surfaces 20 of the transitional blade 4 can complement the arcuate concave surfaces 70 of the arcuate-interface static nozzle blade 60, while the angled interfaces 28 can complement the angled interfaces 58 on the suction side 56 of the angled-interface static nozzle blades 42.

Figure 4:
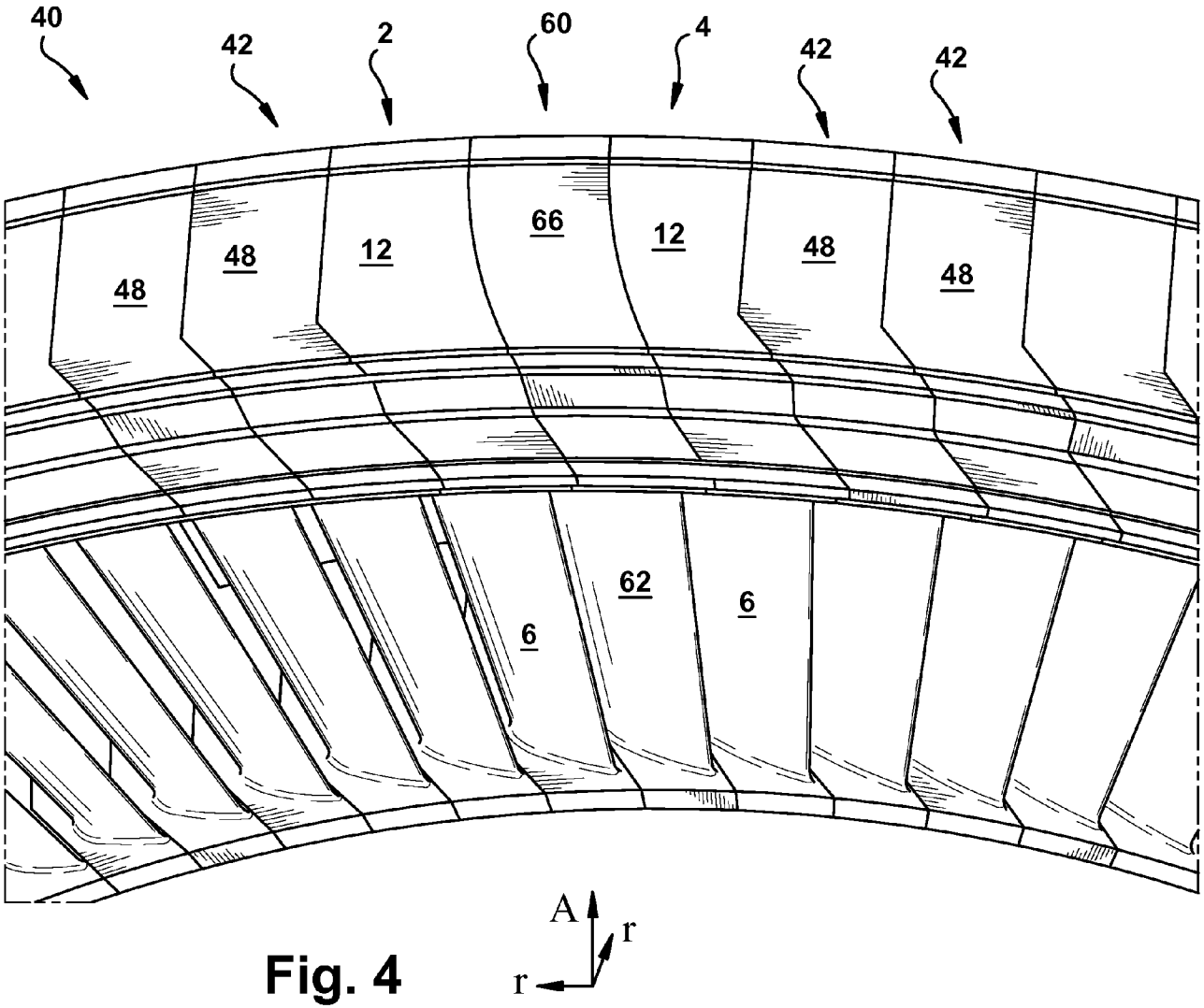
FIG. 4 shows a schematic perspective view of a compiled portion of the annulus of static nozzle blades in FIG. 3.

FIG. 4 shows a schematic perspective view of the portion of the annulus of static nozzle blades 40 as in FIG. 3, however, FIG. 4 shows the assembled annulus 40, where interfaces of adjacent blades contact, and complement, one another. It is understood that as used herein, the term "complement(s)" refers to a relationship between surfaces in which portions of those surfaces may be arranged substantially flush with one another. For example, in one embodiment, pressure-side (arcuate concave) surfaces and suction-side (arcuate convex) surfaces may be arranged in a steam turbine diaphragm assembly (e.g., FIGS. 3, 4 and 5) such that each of the respective (inner, outer) sidewall surfaces of a first steam turbine static nozzle blade are substantially flush with the respective (inner, outer) sidewall surfaces of a second steam turbine static nozzle blade. In any case, FIG. 4 illustrates how a first transitional blade 2, and a second transitional blade 4, can allow for modification of an existing annulus of static nozzle blades 40 from including strictly angled-interface static nozzle blades 40, to including at least one arcuate-interface static nozzle blade 60.

Figure 5:
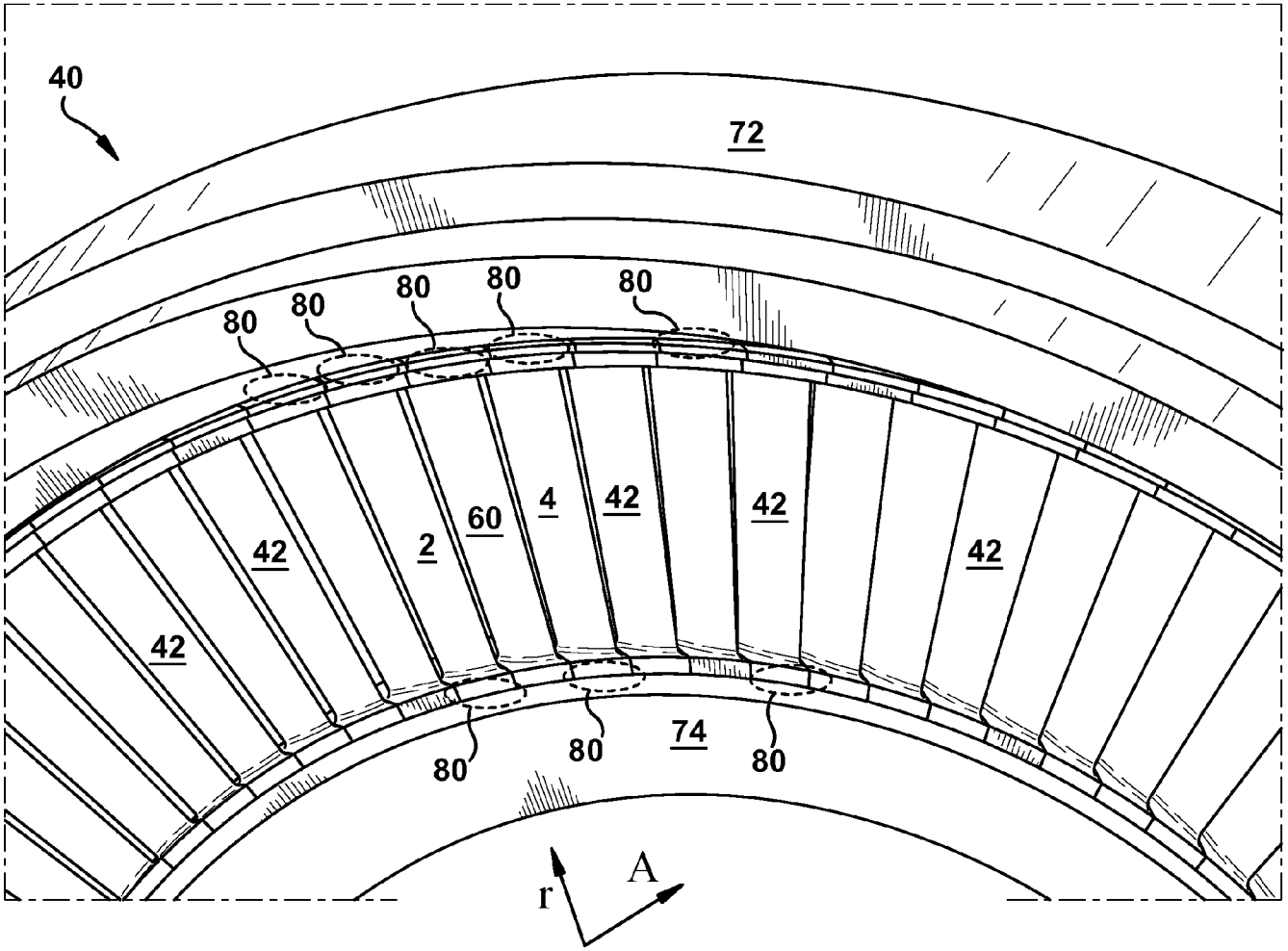
FIG. 5 shows a schematic perspective view of a steam turbine diaphragm assembly according to various embodiments.

This concept is further illustrated in FIG. 5, which shows a schematic perspective view of a steam turbine diaphragm assembly 70 according to various embodiments. As shown, the steam turbine diaphragm assembly 70 includes an outer diaphragm ring 72; an inner diaphragm ring 74 (inner and outer referring to radial coordinates, e.g., radially outer, radially inner); and an annulus of static nozzle blades 40 (as shown and described with reference to FIGS. 3-4) between the inner diaphragm ring 74 and the outer diaphragm ring 72.

As is known in the art, in order to remove a single angled-interface static nozzle blade 40 from a steam turbine diaphragm assembly (e.g., assembly 70), weld joints 80 between sidewalls 46, 48 and the inner diaphragm ring (e.g., inner diaphragm ring 74) and the outer diaphragm ring (e.g., outer diaphragm ring 72), respectively, are removed. Next, due to interference between the angled interfaces on adjacent sidewalls 46, 48, the angled-interface static nozzle blade 40 is bent, broken, or otherwise damaged to remove it axially from the assembly. Applicants have discovered, however, that a set of angled-interface static nozzle blades 40 can be removed from a steam turbine diaphragm assembly (e.g., assembly 70) without substantially damaging the adjacent remaining angled-interface static nozzle blades 40. This is possible because after removing a plurality of weld joints 80, there is sufficient free space to allow a set (e.g., 3 or more) of angled-interface static nozzle blades 40 to be removed from between the inner diaphragm ring 74 and the outer diaphragm ring 72. It is understood that 3 or more angled-interface static nozzle blades 40 can be removed according to various embodiments.

As noted herein, one embodiment of a method can include:

P1: Removing weld joints retaining at least three angled-interface static nozzle blades 40 in a steam turbine diaphragm assembly (e.g., assembly 70) between an inner diaphragm ring 74 and an outer diaphragm ring 72, respectively;

P2: Removing the at least three angled-interface static nozzle blades 40 from the assembly (e.g., assembly 70), leaving a plurality of angled-interface static nozzle blades 40 remaining in the assembly (e.g., assembly 70);

P3: Inserting (including, e.g., welding to inner diaphragm ring 74 and outer diaphragm ring 72, respectively) a first transitional static nozzle blade 2 into the assembly 70 to complement and contact an adjacent angled-interface static nozzle blade 40 (where sidewalls of the respective blades 2, 40 complement and contact each other);

P4: Inserting (including, e.g., welding to inner diaphragm ring 74 and outer diaphragm ring 72, respectively) a second transitional static nozzle blade 4 into the assembly 70 to complement and contact an adjacent angled-interface static nozzle blade 40 (where sidewalls of the respective blades 4, 40 complement and contact each other); and P5: Inserting (including, e.g., welding to inner diaphragm ring 74 and outer diaphragm ring 72, respectively) an arcuate (conical) interface static nozzle blade 60 into the assembly 70 to between the first transitional static nozzle blade 2 and the second transitional static nozzle blade 4, to complement and contact the arcuate interfaces of the first transitional static nozzle blade 2 and the second transitional static nozzle blade 4, respectively.

Figure 6:
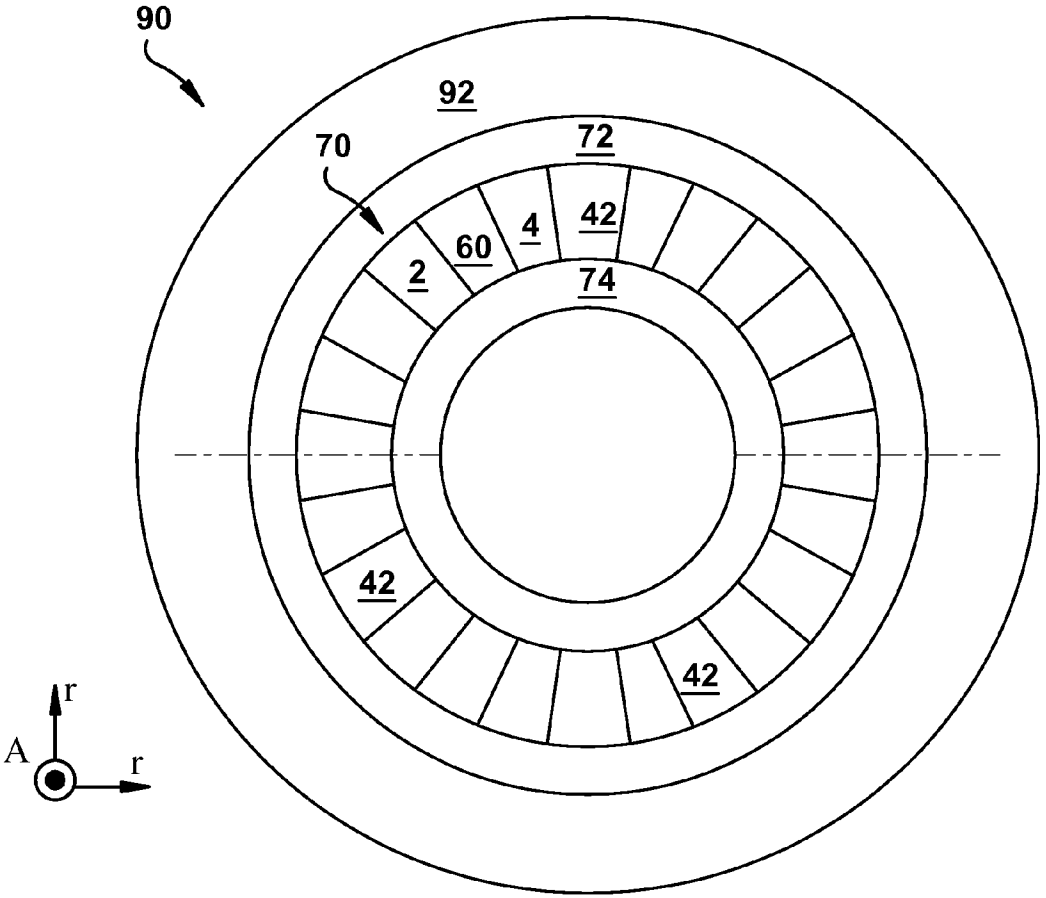
FIG. 6 shows a schematic cross-sectional view of a steam turbine according to various embodiments.

FIG. 6 shows a schematic cross-sectional depiction of a steam turbine 90 according to various embodiments of the invention. As shown, the steam turbine 90 can include a casing segment 92, and a diaphragm assembly 70 (FIG. 5) at least partially contained within the casing segment 92. The diaphragm assembly 70 is described in further detail with respect to the preceding FIGURES herein.

It is understood that according to various embodiments, the angled interfaces shown and described with respect to the transitional static nozzle blades 2, 4 could be formed as substantially flat (straight) faces, which could be combined with intermediary complementary components to interact with the angled interfaces of the existing angled-interface static nozzle blade 40. Additionally, more than two faces could be utilized in the angled-interface of the transitional static nozzle blades 2, 4, e.g., 3 or more faces, at angles of greater than approximately 145 degrees.

It is understood that the transitional static nozzle blades 2, 4 shown and described herein can allow for, among other things, servicing, repair, etc., of turbines that include angled-interface static nozzle blade(s). Applicants have discovered that existing angled-interface static nozzle blades are difficult to repair within a diaphragm assembly (e.g., diaphragm assembly 70), particularly because these blades have been coated prior to introduction to the assembly. The coatings can wear down in high-impact areas (e.g., in the throat region of the blade) where pressure and temperature conditions are most severe. The location of this form of wear can be difficult to access, for example, using line-of-sight. Various embodiments described herein can allow for removal of static nozzle blades (e.g., a set of angled-interface static nozzle blades 40), and replacement of those static nozzle blades with a "book-end" transitional static nozzle blades 2, 4 and interposed arcuate-interface static nozzle blades 60. These arcuate-interface static nozzle blades 60 can be removed from the assembly (e.g., diaphragm assembly 70) without substantially disturbing the weld joints 80 retaining adjacent static nozzle blades. As such, according to various embodiments, methods can include replacing one or more sets of angled-interface static nozzle blades 40 in a steam turbine (e.g., steam turbine 90), for among other reasons, to enhance future servicing of the steam turbine.

It is understood that as described herein, brazing may be performed as an alternative to welding. As is understood in the art, welding and brazing may be used to join metals together. As is further understood in the art, welding may be performed by melting and fusing metals together, usually by adding a filler material. Brazing, by contrast, usually does not involve melting the base metals being joined, and is usually performed at lower temperatures than welding. While metal joints are described herein as "weld joints", it is understood that these metal joints may alternatively be described as "braze joints."

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to an individual in the art are included within the scope of the invention as defined by the accompanying claims.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine diaphragm assembly comprising:

an outer diaphragm ring;

an inner diaphragm ring;

an annulus of static nozzle blades between the inner diaphragm ring and the outer diaphragm ring, the annulus of static nozzle blades including:

a first static nozzle blade including: an airfoil; an inner sidewall integral with a first side of the airfoil; and an outer sidewall integral with a second side of the airfoil; the inner sidewall and the outer sidewall each including: a pressure side having an arcuate concave surface extending substantially an entire length of the sidewall; and a suction side having an arcuate convex surface extending substantially the entire length of the sidewall; and a second static nozzle blade including: an airfoil; an inner sidewall integral with a first side of the airfoil; and an outer sidewall integral with a second side of the airfoil; the inner sidewall and the outer sidewall each including: a first side having one of: an arcuate concave surface extending substantially an entire length of the sidewall, or an arcuate convex surface extending substantially the entire length of the sidewall, the first side complementing one of the pressure side or the suction side of the first static nozzle blade; and a second side opposing the first side and having an angled interface extending substantially the entire length of the sidewall, wherein the angled interface is formed from two distinct continuous sections each having a planar interface, wherein the two distinct continuous sections connect to form an angle.

2. The steam turbine diaphragm assembly of claim 1, further comprising:

a third static nozzle blade including: an airfoil; an inner sidewall integral with a first side of the airfoil; and an outer sidewall integral with a second side of the airfoil; the inner sidewall and the outer sidewall each including: a pressure side having an angled interface extending substantially an entire length of the sidewall; and a suction side having an angled interface extending substantially the entire length of the sidewall.

3. The steam turbine diaphragm assembly of claim 2, wherein the third static nozzle blade complements the second side of the second static nozzle blade.

4. The steam turbine diaphragm assembly of claim 2, wherein the first static nozzle blade complements and contacts the second static nozzle blade, and wherein the second static nozzle blade complements and contacts the third static nozzle blade.

5. The steam turbine diaphragm assembly of claim 1, wherein the first side of the second static nozzle blade includes a pressure side, and wherein the first side of the second static nozzle blade includes the arcuate concave surface.

6. The steam turbine diaphragm assembly of claim 1, wherein the first side of the second static nozzle blade includes a suction side, and wherein the first side of the second static nozzle blade includes the arcuate convex surface.

7. The steam turbine diaphragm assembly of claim 1, wherein the arcuate concave surface or the arcuate convex surface of the second static nozzle blade has an arc radius of 14 centimeters.

8. The steam turbine diaphragm assembly of claim 1, wherein the angled interface is angled to complement an adjacent static nozzle blade in the steam turbine diaphragm assembly, and wherein the angle formed by the two distinct continuous sections is between 115 degrees and 155 degrees.

9. A steam turbine comprising:

a casing segment, and a diaphragm assembly at least partially contained within the casing segment, the diaphragm assembly including:

an outer diaphragm ring;

an inner diaphragm ring;

an annulus of static nozzle blades between the inner diaphragm ring and the outer diaphragm ring, the annulus of static nozzle blades including:

a first static nozzle blade including: an airfoil; and a pair of sidewalls integral with the airfoil, the pair of sidewalls each including: a pressure side having an arcuate concave surface extending substantially an entire length of the sidewall; and a suction side having an arcuate convex surface extending substantially the entire length of the sidewall; and a second static nozzle blade including: an airfoil; and a pair of sidewalls integral with the airfoil, the pair of sidewalls each including: a first side having one of: an arcuate concave surface extending substantially an entire length of the sidewall, or an arcuate convex surface extending substantially the entire length of the sidewall, the first side complementing one of the pressure side or the suction side of the first static nozzle blade; and a second side opposing the first side and having an angled interface extending substantially the entire length of the sidewall, wherein the angled interface is formed from two distinct continuous sections each having a planar interface, wherein the two distinct continuous sections connect to form an angle.

10. The steam turbine of claim 9, further comprising:

a third static nozzle blade including: an airfoil; and a pair of sidewalls integral with the airfoil, the pair of sidewalls each including: a pressure side having an angled interface extending substantially an entire length of the sidewall; and a suction side having an angled interface extending substantially the entire length of the sidewall.

11. The steam turbine of claim 10, wherein the third static nozzle blade complements the second side of the second static nozzle blade, and wherein the angle formed by the two distinct continuous sections is between 115 degrees and 155degrees.

12. The steam turbine of claim 10, wherein the first static nozzle blade complements and contacts the second static nozzle blade, and wherein the second static nozzle blade complements and contacts the third static nozzle blade.

13. The steam turbine of claim 12, further comprising a fourth static nozzle blade abutting and contacting the first static nozzle blade on a side opposite the second static nozzle blade, the fourth static nozzle blade including an airfoil; and a pair of sidewalls integral with the airfoil, the pair of sidewalls each including: a first side having one of: an arcuate concave surface extending substantially an entire length of the sidewall, or an arcuate convex surface extending substantially the entire length of the sidewall, the first side complementing an opposite one of the pressure side or the suction side of the first static nozzle blade from the second static nozzle blade; and a second side having an angled interface extending substantially the entire length of the sidewall.

14. The steam turbine of claim 9, wherein the arcuate concave surface or the arcuate convex surface of the second static nozzle blade has an arc radius of 14 centimeters.

* * * * *